United States Patent [19]

Sjogren

[11] Patent Number: 4,673,296

[45] Date of Patent: Jun. 16, 1987

[54] MIXING PUMP FOR TRANSPORT AND EFFECTIVE MIXING (HOMOGENIZATION) OF TWO OR MORE LIQUIDS (GASES) WITH A CONSTANT, BUT ADJUSTABLE, RATIO OF THE LIQUIDS

[75] Inventor: Arne B. Sjogren, Kirke Såby, Denmark

[73] Assignee: Dymo Science Inc., Tokyo, Japan

[21] Appl. No.: 756,378

[22] Filed: Jul. 18, 1985

[30] Foreign Application Priority Data

Jul. 18, 1984 [DK] Denmark ..... 3505

[51] Int. Cl.[4] ..... B01F 5/00; B01F 15/02; B67D 5/46

[52] U.S. Cl. ..... 366/159; 222/137; 366/177; 366/269; 417/503; 417/555 R

[58] Field of Search ..... 366/160, 162, 268, 269, 366/150, 177, 182, 159; 222/137; 417/349, 503, 555 R

[56] References Cited

U.S. PATENT DOCUMENTS 2,142,062 12/1938 Thurman ..... 366/268 X
2,266,126 12/1941 Malsbary et al. ..... 417/503 X
4,334,787 6/1982 Kluth et al. ..... 366/162

FOREIGN PATENT DOCUMENTS 1296355 11/1972 United Kingdom ..... 366/160

*Primary Examiner*—Philip R. Coe
*Attorney, Agent, or Firm*—Wenderoth, Lind & Ponack

[57] ABSTRACT

The invention is drawn to a mixing pump which can transport and effectively mix (homogenize) two or more liquids (or gases) in all ratios between the pure components. The ratio is constant, but is adjustable. This is effected by a double-acting pump cylinder (or two coupled, single-acting cylinders) which produces a charge of the mixture in a two-stroke-cycle. During the 1st stroke liquid (V1) is pumped from one side of the piston (2) through a restriction (12) (pressure drop) into the liquid (V2), while the liquid (V2) is sucked into the cylinder on the other side of the piston. During the 2nd stroke the mixture (V1+V2) is pumped to a storage tank through a restriction (13) (pressure drop), while the liquid (V1) is sucked into the cylinder. By adjusting (by regulator 6), the amount of the liquid (V1) pumped into the liquid (V2), the pump can deliver any ratio of the two components. By choosing the velocity of the piston and of the coefficient of resistance of the restrictions, the necessary pressure drops for every purpose can be obtained.

6 Claims, 6 Drawing Figures

MIXING PUMP FOR TRANSPORT AND EFFECTIVE MIXING (HOMOGENIZATION) OF TWO OR MORE LIQUIDS (GASES) WITH A CONSTANT, BUT ADJUSTABLE, RATIO OF THE LIQUIDS

BACKGROUND OF THE INVENTION

The invention concerns a mixing pump, which can perform pumping of two or more liquids from the storage of the components to the storage of the mixed product and at the same time mix the liquids very effectively in a constant, but adjustable, ratio of the components.

Numerous industries and especially the chemical industry and the fuel industry, want to mix two or more liquids very effectively and in a constant ratio of the liquids (adjustable). The requirements for a real effective mixing (in microphase) and for a constant ratio, independent of the capacity, are often very strict, and it has of course been possible to fulfill these requirements during the past years with technical ingenuity, but the solutions to the problems have mostly been complicated and expensive.

It is evident, that one can fulfil the above-mentioned requirements by means of the advanced technique of today, comprised of a plant consisting of one or more of the following components: metering pumps, pumps, flow-controls, regulating valves, various mixing equipment (for instance static mixers), and the newest data techniques.

However, very often the above technique becomes complicated and expensive and very vulnerable to operational disorders.

SUMMARY OF THE INVENTION

The mixing pump, according to the invention, gives, on the contrary, in most cases a very simple and inexpensive solution to the problems, and a solution, which can be very reliable.

Mixing of two or more liquids is often a complicated matter. It is easy to mix two completely miscible liquids with low viscosity, but often one is confronted with one or more of the following problems:

1. The liquids have a high viscosity
2. The liquids have a widely different temperature
3. The liquids are not miscible If the liquids are miscible, but of a high viscosity and/or of a widely different temperature (1. and 2.), an effective mixing is not easily accomplished.

The keyword here is "energy", because only the use of an adequate amount of energy will make it possible to obtain a sufficient mixture of the components within a short time.

However, if the liquids are not miscible, there will be special requirements for equipment and an energy supply to obtain a satisfactory emulsion. Depending on equipment and the energy supply, the emulsion can turn out to be "coarse" or "fine".

Some emulsions are stable (or almost stable), which means that they can keep for a long time without any separation.

The stability depends both on the liquids themselves and on the effectiveness of the emulsifying process (equipment, energy supply).

Other emulsions are unstable and will separate within a short time, unless an "emulsifier" is added (an emulsifier is a chemical, which stabilizes the emulsion).

Well-known examples of the two types of emulsion are: water-in-fuel oil emulsions and water-in-diesel oil emulsions.

Water-in-fuel oil emulsions are naturally stable (contain surfactants) and thus, with the right equipment and the right energy supply, it is possible to make emulsions that are stable for years.

Water-in-diesel oil emulsions are, however, very unstable and no matter how effective the equipment is and how much energy is supplied, the emulsion will separate within a short time.

Finally, it has to be mentioned, that there are many cases where the components for the mixing are inhomogeneous themselves (for instance fuel oil), so that the ideal mixing equipment, in excess of the mixing process, has to take care of the conditioning (homogenization) of the components.

The mixing pump, according to the invention, fulfills this requirement.

The above-mentioned problems deal with the effectiveness of the mixing, which is one side of the complexity in solving the above-mentioned problems.

Another side, and not the least important, pertains to the ratio of the liquids, which very often has to be very constant and independent of the rate of production. Moreover the ratio has to be easily adjustable.

Finally, the ratio must be constant even in case of ratios between 1:10 and 1:100.

All these problems, mentioned above, are solved by the mixing pump, according to the invention, easily and in an uncomplicated manner.

There are normally two different ways of making mixtures. Either discontinuously, where the right amounts of the components are added to a container and mixed, or continuously, where the components are continuously fed to the mixing equipment by means of metering pumps, flow-controls, flow-meters, nozzles, orifices or the like.

The mixing pump, according to the invention, is something between these two extremities, as it works discontinuously-continuously, which means, that the mixing pump several times per minute makes a small charge of the mixture with the right ratio of the components.

The capacity of the mixing pump is, except for the size of the pump, thus dependent on the number of charges per minute and on whether the pump is in operation or not.

The last two variables make capacities between zero and the maximum of the mixing pump possible.

BRIEF DESCRIPTION OF THE DRAWINGS

The invention can be explained in detail with reference to the drawings.

a. for two components b. for three components.

DESCRIPTION OF THE PREFERRED EMBODIMENTS

Figure 1:
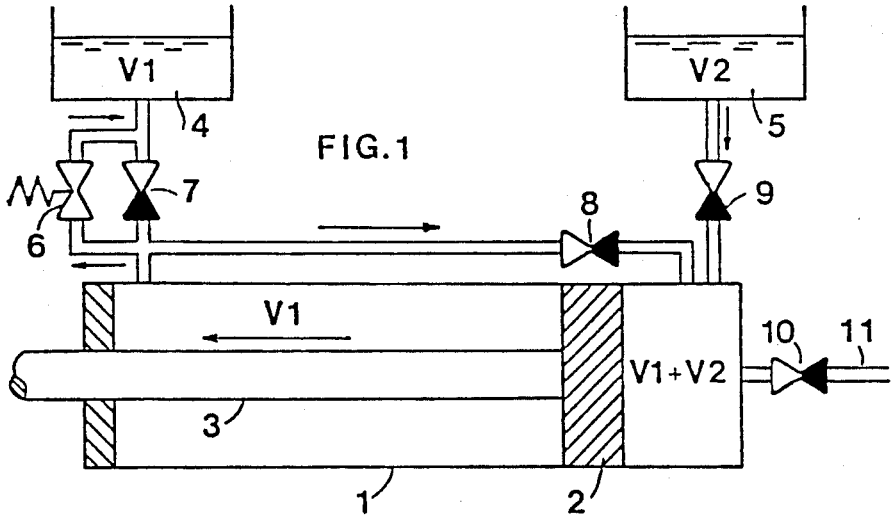
FIG. 1 is a schematic drawing of the double-acting pump cylinder, showing the movements of the piston and the flow of the liquids during the 1st stroke.

As seen in FIG. 1, the heart of the mixing pump is a cylinder (1) with a piston (2), known from piston pumps, steam-engines and hydraulics. The cylinder shown is double-acting, i.e., both sides of the piston (right and left chamber) are used for pumping and the pump cylinder is thus working both during the forward and backward movement of the piston (1st and 2nd stroke). The liquids in the two chambers are the two mixing components.

This is the preferred construction of the invention.

This is because the construction results in certain advantages related to greater simplicity, less space and fewer problems with tightening, but the invention also covers the separate, single-acting, coupled pump cylinders, where each cylinder pumps a single liquid. This could for instance be preferable for mixing of more than two liquids.

FIG. 1 shows furthermore, that a stroke of the piston to the left (in the figure) pumps the liquid V1 from the left chamber into the liquid V2 at the same time as this liquid V2 is sucked into the right chamber from the storage tank (5) for V2.

Figure 2:
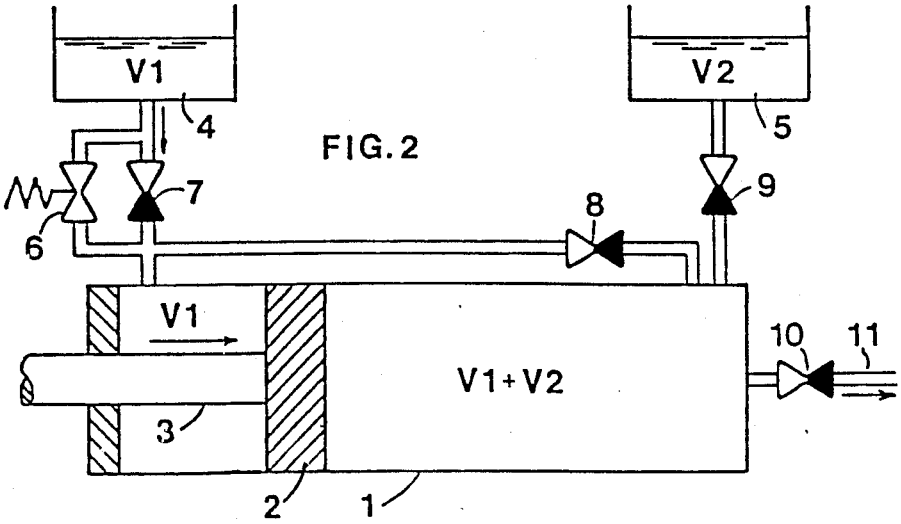
FIG. 2 is a view of the apparatus of FIG. 1 during the 2nd stroke.

FIG. 2 shows the situation, when the piston, after having completed the 1st stroke, moves to the right (2nd stroke). Due to the non-return valves (check valves) (7), (8) and (9) in the system, the flow is now changed so that the mixture of V1+V2 in the right chamber is pressed out through the non-return valve (10) and the outlet (11) to a storage tank for the mixture of V1+V2. At the same time the liquid V1 is sucked into the left chamber from the storage tank for V1 (4).

It is evident, that if the total amount of V1 from the left chamber runs into the right chamber, there would be no space for the liquid V2.

Mixing of the two liquids and mixing in different ratios of the two liquids will therefore require, that a certain part of the liquid V1 runs back to the storage tank instead of running into the right chamber.

This "splitting" of the amount of V1 is brought about by means of the regulating device (6) shown in FIGS. 1, 2, 3 and 4. This part of the mixing pump can, in practice, be made in many different ways, according to the purpose (use) of the mixing pump.

The choice of a regulating device will also in every case depend on whether the ratio of the liquids has to be constant (but still adjustable) or easily adjustable.

The regulating device (6) could for instance be a pressure-regulating valve (as shown in the FIGS. 1, 2, 3 and 4) or a flow control valve, but it could also just be orifices or nozzles, providing a constant drain of V1 back to the storage tank (4).

The above explanation of FIGS. 1 and 2 deals with that part of the invention which ensures a constant (but adjustable) ratio of two (eventually more) liquids.

The characteristic of this part of the invention is, that the mixing pump with a double stroke of the piston, from a position to the right (in FIGS. 1 and 2) over to a position to the left and back again to a position to the right, makes a complete cycle, i.e., produces a charge of the mixture of two or more components. Each charge will have the same ratio of the two liquids and the capacity of the mixing pump is just a matter of the number of charges per time unit.

Almost all ratios are possible. It is seen, from FIGS. 1 and 2, that a complete opening of (6) to the storage tank (4) will result in 100% V2 in the mixture, while a complete closing of (6) will result in almost 100% V1 in the mixture.

Between these extremities all other ratios are possible.

This was the contribution of the invention for obtaining a constant ratio of the liquids. The other part of the invention is the contribution for obtaining an effective mixing of two (or more) liquids.

As mentioned earlier it is often very difficult to mix liquids effectively and at the same time condition the components, if they are inhomogeneous. In any case this requires an energy supply.

Only by providing a sufficient energy supply is it possible to overcome the forces, surface forces, shearing forces etc., which try to counteract the mixing.

The mixing pump, according to the invention, is absolutely superior in this respect, as the construction allows one to supply precisely as much energy to the mixing as needed. It is just a question of the supplied effect and, of course, last but not least, of the energy consumption.

The energy is used to force the liquids (the mixture) through a high pressure drop, and this requires restrictions over which one can create the high pressure drops.

Such restrictions could be orifices, nozzles, holes or sintered materials etc. There exists numerous constructions known for instance in the homogenization industry, and, it is unessential for the invention as to which construction is used.

It is solely important to make the pressure drop high enough so that the mixing is effective and that eventual inhomogeneous components are homogenized.

Figure 3:
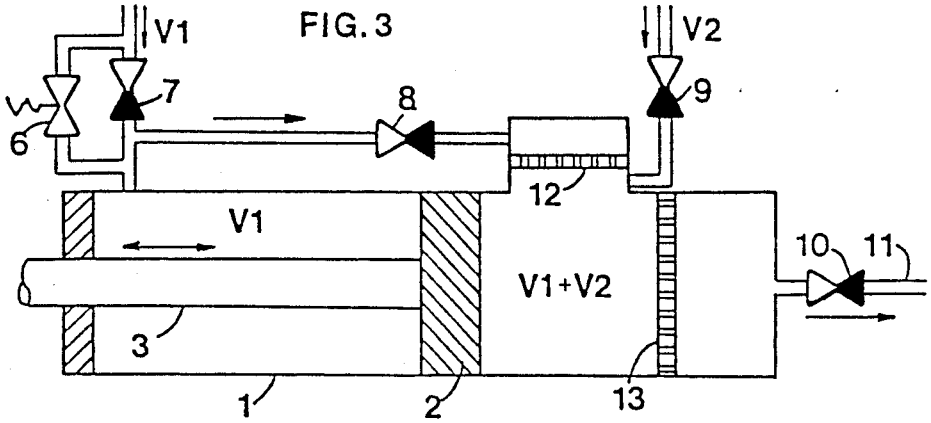
FIG. 3 is a schematic drawing showing one construction of the mixing pump having restrictions.
Figure 4:
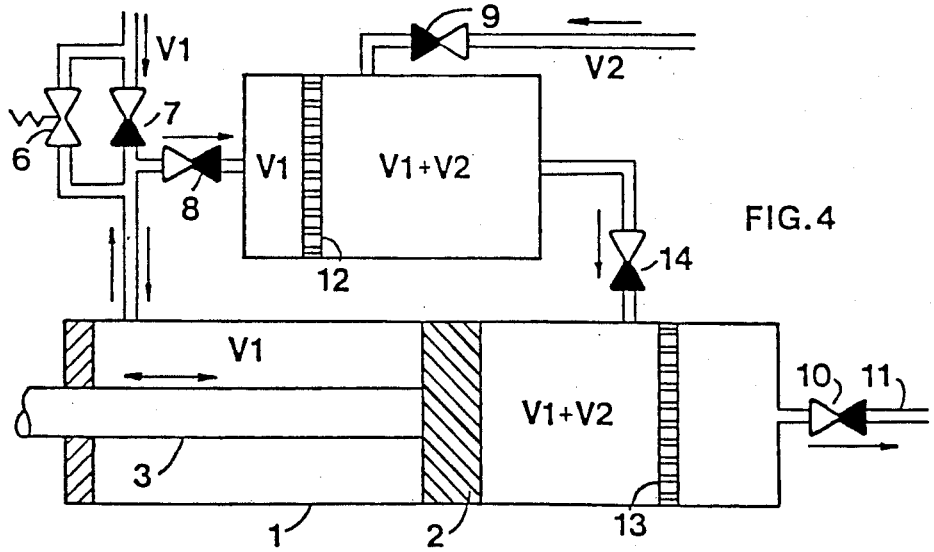
FIG. 4 is a drawing showing another construction of the mixing pump with the first restriction in a separate chamber (cylinder).

In FIGS. 3 and 4, the restrictions in two different constructions of the mixing pump are shown.

In FIG. 3 the liquid V1 is atomized into the liquid V2 through the wall of the cylinder, while V1 in FIG. 4 is atomized into V2 in a separate chamber (cylinder).

This is just two examples of constructions of the pump within the scope of the invention, and they do not exclude other constructions working in accordance with the same basic principles.

In both FIG. 3 and FIG. 4 the liquid V1 is conveyed to the liquid V2 through the restriction (12) during V2's suction into or on its way to the cylinder (1st stroke).

If the liquids are easily miscible a good mixing takes place.

If the liquids are non-miscible the liquid V1 will be atomized (emulsified) into liquid V2 and will be distributed as small droplets in V2.

When the mixture (the emulsion) is pumped out of the cylinder (2nd stroke) it passes another restriction (13), which causes a pressure drop and the mixture of miscible liquids is finally and completely mixed and the mixture of non-miscible liquids is completely homogenized.

This is also true for liquid V2, if this liquid is inhomogeneous from the start.

The mixing pump, according to the invention, is superior in respect to the effectiveness of the mixing (emulsification, homogenization), as the pressure drop across the restrictions can be fixed freely at a given size, providing the desired mixing quality.

The pressure drop is just a matter of the "resistance" of the restrictions and of the velocity of the piston. As the pump cylinders (hydraulic cylinders are very suitable) normally are dimensioned for pressures up to 200 bars it is easy to find a suitable pressure drop for every purpose.

The fixing of the pressure drop will in most cases probably take place after a careful consideration of the quality of the mixture contra the energy consumption.

The above text only describes the mixing of two or more liquids.

However, according to the principle of the invention, one of the liquids or all the liquids could easily be replaced by one or more gases.

Mixing of one gas into a liquid (soluble or insoluble) or mixing of two or more gases is thus possible.

The explanation of the invention in which one or more gases is used is the same as the explanation above in which liquids are used.

The same advantages that result when liquids are used are also derived from using one or more gases, i.e., a constant (but adjustable) ratio and a very effective mixing (homogenization) of the components is possible.

As the high technical standards of today within the hydraulics industry has made double-acting cylinders very reliable, the construction with double-acting cylinders is generally preferred as it is the most reliable.

This excludes by no means, that the mixing pump, according to the invention, can be built of separate single-acting, coupled cylinders, and this construction could possibly in some cases be the best, for instance, if more than two liquids/gases are going to be mixed.

In FIG. 5, a couple of examples of constructions with separate coupled cylinders are shown.

Figure 5A:
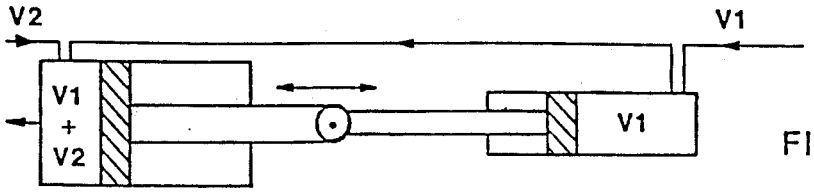
FIG. 5 is a drawing showing the construction according to the invention having single-acting, coupled pump cylinders.
Figure 5B:
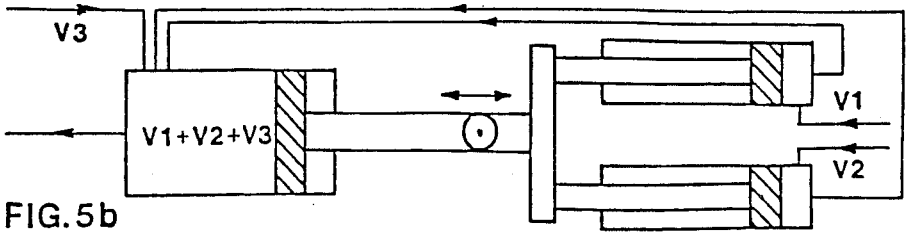

In FIG. 5*a* an example of the mixing of two components is shown, while in FIG. 5*b*, mixing of three components is shown.

The explanation, given above for double-acting cylinders is similar to that for two or more single-acting cylinders.

The mixing pump, according to the invention, can be used for all types of mixing tasks, where a constant ratio and effective mixing is desired, and the example below limits therefore by no means the broad field of application.

The example is included only to show the effectiveness of the invention in a single field, namely, conditioning of heavy fuel oil by water addition and homogenization.

EXAMPLE

It is a well-known matter that mixing of water into fuel oil improves the combustion of the former, i.e. reduces the particulate emission.

The coarser the water that is emulsified into the oil and the lower the amount of fuel oil that is homogenized, the greater the amount of water that is necessary to obtain good combustion. With ineffective equipment it can be necessary to use as much as 10–20% water.

With more effective equipment it is possible to use an amount of water as low as 5%, but even with such equipment there can be problems with certain types of fuel oils, if these are not effectively homogenized.

Below, the results are shown from a test with the mixing pump, according to the invention:

DATA: Pressure Jet Burner, load 550 kg oil/h, extra heavy fuel oil (77 cS at 80° C.), excess air: 2.3% $O_2$.

| Test no. | Water % | Homogenizing pressure bars | Particulate Emission g/kg oil | Reduction of emission % |
|---|---|---|---|---|
| 1 | 0 | 0 | 6.4 | — |
| 2 | 0 | 7 | 3.5 | 45 |
| 3 | 0 | 15 | 2.2 | 65 |
| 4 | 0 | 25 | 1.2 | 81 |
| 5 | 5.4 | 0 | 2.5 | 61 |
| 6 | 5.4 | 7 | 0.7 | 89 |
| 7 | 5.4 | 15 | 0.3 | 95 |
| 8 | 5.4 | 25 | 0.2 | 97 |
| 9 | 2.1 | 0 | 3.1 | 51 |
| 10 | 2.1 | 7 | 1.0 | 81 |
| 11 | 2.1 | 15 | 0.5 | 93 |
| 12 | 2.1 | 25 | 0.3 | 95 |

To show a better survey of the above results, they are set up in an easier way to see as follows:

| | % Water | | |
|---|---|---|---|
| Pressure drop in bars | 0 | 2.1 | 5.4 |
| 0 | — | 51 | 61 |
| 7 | 45 | 81 | 89 |
| 15 | 65 | 93 | 95 |
| 25 | 81 | 95 | 97 |

It is seen, that the homogenizing pressure drop has a big influence upon the particulates reduction and especially when there is less water in the oil.

It is also seen, that it is possible to cut down on the water, if the mixing pump is running at a higher homogenization pressure drop. Since the pump gives a loss of 0.08% per percent of water, it is important to economize on the water.

Finally, it should be mentioned, that the piston movement in the mixing pump can be effected by the available power transmission methods, for instance electrical motors via cranks, racks, threaded screws or ball bearing screws or with hydraulic, pneumatic or steam cylinders.

I claim:

1. A mixing pump for effectively mixing a constant ratio of at least first and second fluids supplied from respective fluid supply sources and transporting the mixture of the at least first and second fluids to a tank, said pump comprising:

a cylinder means having a piston means slidably fitted therein, said piston means being movable back and forth between a first position adjacent one end of said cylinder means and a second position adjacent the other end of the cylinder means;

said cylinder means having a first fluid inlet means operatively connected between the supply source of the at least first fluid and said one end of said cylinder means for supplying first fluid from supply source of the at least first fluid to the cylinder means between said piston means and said one end of the cylinder means when said piston means is moved from said first position to said second position and for allowing the at least first fluid between said piston means and said one end of the cylinder to leave said cylinder means when said piston means is moved from said second position to said first position;

said cylinder having a second fluid inlet means operatively connected between the supply source of the second fluid and said other end of said cylinder means for supplying second fluid from the supply source of the second fluid to the cylinder means between the piston means and said other end of the cylinder means when said piston means is moved from said second position to said first position;

a fluid mixing line operatively connected between said first fluid inlet means and said other end of said cylinder means for receiving the at least first fluid leaving the cylinder means from said first inlet means and for supplying the same to said other end of said cylinder means where the at least first fluid mixes with the second fluid to form a mixture when said piston means is moved from said second position to said first position; and a fluid mixture outlet means located at said other end of said cylinder means for allowing the mixture of the at least first fluid supplied to said other end of said cylinder means by said fluid mixing line and the second fluid supplied to said other end of said cylinder means by said second fluid inlet means to pass from said cylinder means when said piston means is moved from said first position to said second position.

2. The pump as claimed in claim 1 wherein, said cylinder means comprises a first cylinder means and a second cylinder adjacent one another;

said piston means comprises a first piston means slidably fitted in said first cylinder means, a second piston slidably fitted in said second cylinder, and a piston rod means extending between and connected to said first piston means and said second piston, said piston means being movable back and forth between said first position in which said first piston means is adjacent a first end of said first cylinder means and said second piston is spaced away from a first end of said second cylinder and said second position in which said first piston means is spaced away from said first end of said first cylinder means and said second piston is adjacent said first end of said second cylinder;

said first cylinder having said first fluid inlet means operatively connected between the supply source of the at least first fluid and said first end of said first cylinder means for supplying the at least first fluid from said fluid supply source of the at least first fluid to the first cylinder means between the first piston means and said first end of said first cylinder means when said piston means is moved from said first position to said second position and for allowing the at least first fluid in said first cylinder means between said first piston means and said first end of said first cylinder means to leave said first cylinder means when said piston means is moved from said second position to said first position;

said second cylinder having said second fluid inlet means operatively connected between the supply source of said second fluid and said first end of said second cylinder for supplying the second fluid from the supply source of the second fluid to the second cylinder between the second piston and said first end of said second cylinder when said piston means is moved from said second position to said first position;

said fluid mixing line means being operatively connected between said first fluid inlet means and said first end of said second cylinder for receiving the at least first fluid leaving said first cylinder means and for supplying the same to said first end of said second cylinder when said piston means is moved from said second position to said first position; and said fluid mixture outlet means being located at said first end of said second cylinder for allowing the mixture of the at least first fluid supplied to said first end of said second cylinder by said fluid mixing line and said second fluid supplied to said second cylinder by said second fluid inlet means to pass out of said second cylinder to the tank.

3. A mixing pump as claimed in claim 2 wherein, said first fluid inlet means comprises a regulator means for allowing a portion of the at least first fluid leaving said first cylinder means out said first fluid inlet means to return to the supply source of the at least first fluid, said regulator means being adjustable so that said portion may be between 0% and 100% of the liquid leaving the first cylinder means out said first fluid inlet means.

4. A mixing pump as claimed in claim 2 and further comprising, a first restriction means operatively connected between said fluid mixing line means and said first end of said second cylinder for creating a pressure drop in the flow of the at least first fluid as it is supplied to the second cylinder by said fluid mixing line means and for atomizing the same into the second fluid supplied to said first end of said second cylinder; and a second restriction means located between said first end of said second cylinder and said fluid mixture outlet means for further mixing and homogenizing the mixture of the at least first fluid and the second fluid in said first cylinder as the mixture passes out of said second cylinder to the tank.

5. A mixing pump as claimed in claim 1 wherein, said first fluid inlet means comprises a regulator means for allowing a first portion of the first fluid leaving said cylinder from said first inlet means when said piston is moved from said second position to said first position to pass back to the first fluid supply source, said regulator means being adjustable so that the portion may be between 0% and 100% of the first fluid leaving the cylinder through said first inlet means.

6. A mixing pump as claimed in claim 1 and further comprising, a first restriction means operatively connected between said fluid mixing line and said other end of said cylinder means for creating a pressure drop in the flow of the first fluid supplied to said other end of said cylinder means by said fluid mixing line and for atomizing the same into the second fluid supplied to the other end of said cylinder means by said second fluid inlet means; and a second restriction means located between said other end of said cylinder means and said fluid mixture outlet means for further mixing and homogenizing the mixture of the at least first fluid and the second fluid as the mixture passes out of said other end of said cylinder means to the tank.

* * * * *